US007084845B2

(12) United States Patent
Hong

(10) Patent No.: US 7,084,845 B2
(45) Date of Patent: Aug. 1, 2006

(54) APPARATUS AND METHOD OF DRIVING LIQUID CRYSTAL DISPLAY FOR WIDE-VIEWING ANGLE

(75) Inventor: Hyung Ki Hong, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 284 days.

(21) Appl. No.: 10/183,479

(22) Filed: Jun. 28, 2002

(65) Prior Publication Data

US 2003/0006952 A1 Jan. 9, 2003

(30) Foreign Application Priority Data

Jul. 4, 2001 (KR) ..... 2001-39718

(51) Int. Cl.
*G09G 3/36* (2006.01)

(52) U.S. Cl. ..... 345/89; 345/87; 345/690

(58) Field of Classification Search ..... 345/87, 345/89, 97, 690, 691; 349/33, 173
See application file for complete search history.

(56) References Cited

U.S. PATENT DOCUMENTS 5,103,298 A * 4/1992 Kashimura et al. ..... 348/572
5,489,917 A * 2/1996 Ikezaki et al. ..... 345/89
5,847,688 A * 12/1998 Ohi et al. ..... 345/98
5,877,737 A * 3/1999 Kim et al. ..... 345/89
6,181,400 B1 * 1/2001 Yang et al. ..... 349/117
6,271,820 B1 * 8/2001 Bock et al. ..... 345/97
6,654,028 B1 * 11/2003 Yamakawa ..... 345/690
2002/0149598 A1 * 10/2002 Greier et al. ..... 345/589

* cited by examiner

*Primary Examiner*—Kent Chang
(74) *Attorney, Agent, or Firm*—McKenna Long & Aldridge LLP

(57) ABSTRACT

This invention relates to a method and apparatus for driving a liquid crystal display that is capable of improving the viewing angle by converting a gray scale having poor viewing angle characteristics into a gray scale combination having good viewing angle characteristics. A driving method of a liquid crystal display for wide viewing angle of the present invention, time-divides one frame into at least two sub-frames for driving the liquid crystal display such that an arbitrary main grayscale is expressed by the combination of the sub-grayscales expressed at each of at least two sub-frames. Accordingly, the grayscale with poor viewing angle characteristics is time-divided into at least two grayscales with good viewing angle characteristics and the liquid crystal display is driven, thereby improving the viewing angle.

13 Claims, 6 Drawing Sheets

APPARATUS AND METHOD OF DRIVING LIQUID CRYSTAL DISPLAY FOR WIDE-VIEWING ANGLE

This application claims the benefit of Korean Patent Application No. P2001-39718, filed in Korea on Jul. 4, 2001, which is hereby incorporated by reference.

BACKGROUND OF THE INVENTION

1. Field of the Invention

The present invention relates to a driving technique of a liquid crystal display for obtaining wide-viewing angle, and more particularly to a liquid crystal display driving apparatus and method capable of improving the viewing angle by converting a gray scale that has poor viewing angle characteristics into a gray scale combination that has good viewing angle characteristics.

2. Description of the Related Art

A liquid crystal display (LCD) controls the light transmittance of a liquid crystal used in the electric field to display a picture. Gate lines and data lines are arranged to intersect in the liquid crystal display, and liquid crystal cells are positioned at the intersection of the gate lines and the data lines. Each of the liquid crystal cells has pixel electrodes and a common electrode for applying an electric field. Each of tile pixel electrodes receives video signals, via a thin film transistor (TFT) that is a switching device.

The liquid crystal alignment state is changed in accordance with the received video signal that controls the light transmittance such that the liquid crystal display displays a picture.

As shown in FIG. 1, an apparatus for driving such a liquid crystal display, includes a gate driver (8) for driving gate lines (G1 to Gn) of the liquid crystal display (10), a data driver (6) for driving data lines (D1 to Dm) of the liquid crystal display (10), a gamma circuit (5) for supplying gamma voltage to the data driver (6), and a timing controller (4) for controlling the gate driver (8) and the data driver (6).

The liquid crystal display (10) includes liquid crystal cells (12) arranged in a matrix shape and thin film transistors (TFT) each formed at the intersection of n pieces of the gate lines (G1 to Gn) and m pieces of the data lines (D1 to Dm). The TFT responds to a gate signal from the gate lines (G1 to Gn) to supply the video signal from the data lines (D1 to Dm) to the liquid crystal cells (12). The liquid crystal cell (12) can equivalently be displayed as a liquid crystal capacity capacitor (Clc) that includes common electrodes facing each other with liquid crystal therebetween and a pixel electrode connected to the TFT.

A storage capacitor (Cst) is formed in the liquid crystal cell (12) and sustains the charged data voltage at the liquid crystal capacity capacitor (Clc) until the next data voltage is charged. The storage capacitor (Cst) is formed between the previotis gate line and the pixel electrode.

The gate driver (8) sequentially supplies gate signals to the gate lines (G1 to Gn) to drive the TFT's connected to the corresponding gate line.

The gamma circuit (5) generates direct current gamma voltage predetermined to have different voltage levels from each other in accordance with a grayscale, that is, the gamma circuit generates the voltage level of the video data signal, and supplies that signal to a data driver (6).

The data driver (6) converts the video data signal to an analogue signal from the gamma circuit (5), and supplies a signal to the data lines (D1 to Dm) by 1 horizontal line per 1 horizontal interval when the gate signal is supplied to the gate line (GL).

The timing controller (4) responds to clock signals, horizontal and vertical synchronous signals, and any other signal from a system driver (not shown) so as to control the driving timing of the gate driver (8) and the data driver (6). In other words, the timing controller (4) responds to the clock signals, the horizontal and vertical synchronous signals, and other signals, and generates gate clock signals, gate control signals. gate start pulses and other signals, and supplies those signals to the gate driver (8). In addition, the timing controller (4) generates data clock signals, polarity reverse signals and supplies those signals to the data driver (6). At the same time, the timing controller (4) synchronizes with the data clock signal and supplies video data of red, green and blue to the data driver (6).

Such a liquid crystal display has the advantages of being small in size, thin and consuming low power. Whereas, its disadvantage is its narrow viewing angle because liquid crystal has an anisotropic property.

There are various proposed methods to form liquid crystal displays having a wide-viewing angle. These proposed methods include the Multi Domain method, Halftone Grayscale method and other methods.

The Multi Domain method divides one pixel area into at least two domains, then sets up the alignment direction of the liquid crystal different from one another in each of the domains to compensate the viewing angle characteristics. However, because the Multi Domain method requires several rubbing processes, its manufacturing process becomes complicated.

The Halftone Grayscale method divides one pixel into at least two areas, and applies different voltages to the areas to obtain grayscale, thereby improving the viewing angle characteristics. Generally, the liquid crystal in Twisted Nematic mode (hearafter TN mode) shows worse viewing angle characteristics at the middle grayscale than at black or white grayscale.

To solve this problem, the Halftone Grayscale method divides the middle greyscale (i) having a poor viewing angle characteristic into two sub-areas (12A, 13B), as shown in FIG. 2B. FIG. 2A shows a pixel (12) of a general grayscale method. More particularly, the Halftone Grayscale method applies different voltages to each of the sub-areas (12A, 12B) of the grayscale (A, B). And the middle grayscale is formed from the sum of the grayscales (A+B) improving the viewing angle.

Although the Halftone grayscale has the advantage of improving the viewing angle characteristic due to the larger number of sub areas in one pixel, resolution deteriorates according to the number of space divisions of the pixel area. Also, because the Halftone grayscale method mostly uses a floating pixel electrode and an insulating layer for applying the different voltages from one sub-area to another, the Halftone grayscale method requires additional manufacturing processes for forming the pixel electrode. Also, voltage-light characteristics differ from each sub-area where the floating electrode is located resulting in a brightness difference between the sub-areas where the same voltage is applied, resulting in deteriorated picture quality.

SUMMARY OF THE INVENTION

Accordingly, the present invention is directed to a liquid crystal display driving apparatus and a method that substantially obviate one or more of the problems due to limitations and disadvantages of the related art.

An object of the present invention is to provide a liquid crystal display driving apparatus and a method thereof for a wide viewing angle capable of improving the viewing angle by materializing Halftone Grayscale method by means of time division.

Additional features and advantages of the invention will be set forth in the description which follows, and in part will be apparent from the description, or may be learned by practice of the invention. The objective and other advantages of the invention will be realized and attained by the structure particularly pointed out in the written description and claims hereof as well as the appended drawings.

To achieve these and other advantages and in accordance with the purpose of the present invention, as embodied and broadly described, the method of driving a liquid crystal display for wide-viewing angle includes time-dividing one-frame into at least two sub-frames such that an arbitrary main grayscale is expressed by the combination of the sub-grayscales expressed at each of at least two sub-frames.

In another aspect of the present invention, the method of driving a liquid crystal display for wide viewing angle includes repeatedly outputting video data, input from outside every sub-frame during one frame that is composed of at least two sub-frames; supplying gamma voltages that are set up differently from one another every sub-frame in relation to the same brightness; and converting the video data into analog signals in use of the gamma voltages, and supplying a signal to the liquid crystal display wherein the desired grayscale is expressed by means of the combination of grayscales expressed at the sub-frames.

In another aspect of the present invention, a driving apparatus for a liquid crystal display includes a liquid crystal display including a plurality of gate lines, a plurality of data lines and a plurality of liquid crystal cells; a timing controller repeatedly outputting a plurality of control signals and video data, input from outside, every sub-frame during one frame that is composed of at least two sub-frames; at least two gamma circuits supplying gamma voltages that are set up differently from one another in relation to the same brightness; a gate driver responding to the control of the timing controller and driving the gate lines; a data driver responding to the control of the timing controller and driving the data lines; and a switch responding to the control of the timing controller and selectively connecting the gamma circuits with the data driver every sub-frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Reference will now be made in detail to the preferred embodiments of the present invention, examples of which are illustrated in the accompanying drawings.

FIGS. 3 to 6 illustrate an embodiment of the present invention the details of which are as follows.

Figure 1:
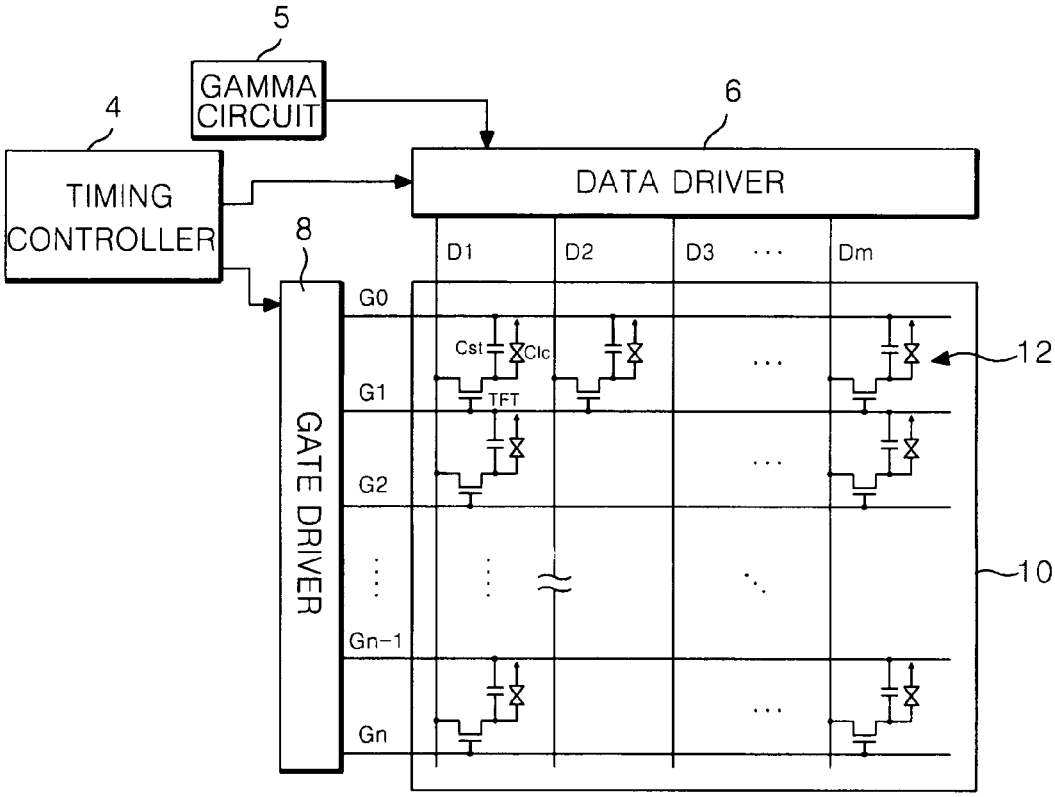
FIG. 1 CONVENTIONAL ART
FIG. 1 is a block diagram showing the configuration of a conventional liquid crystal display driving apparatus.
Figure 2A:
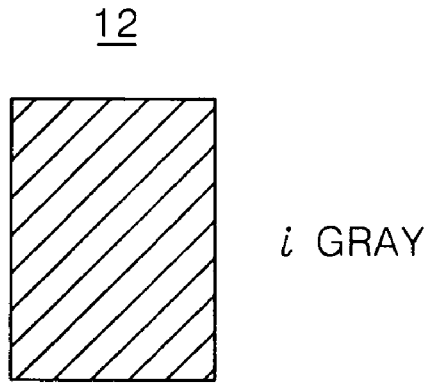
FIG. 2A CONVENTIONAL ART
FIGS. 2A and 2B show a pixel of a general grayscale in comparison with a conventional Halftone grayscale pixel.
Figure 2B:
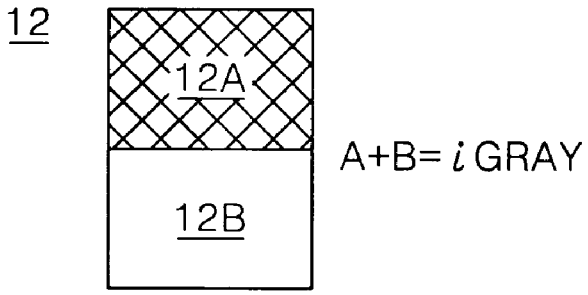
FIG. 2B CONVENTIONAL ART
Figure 3:
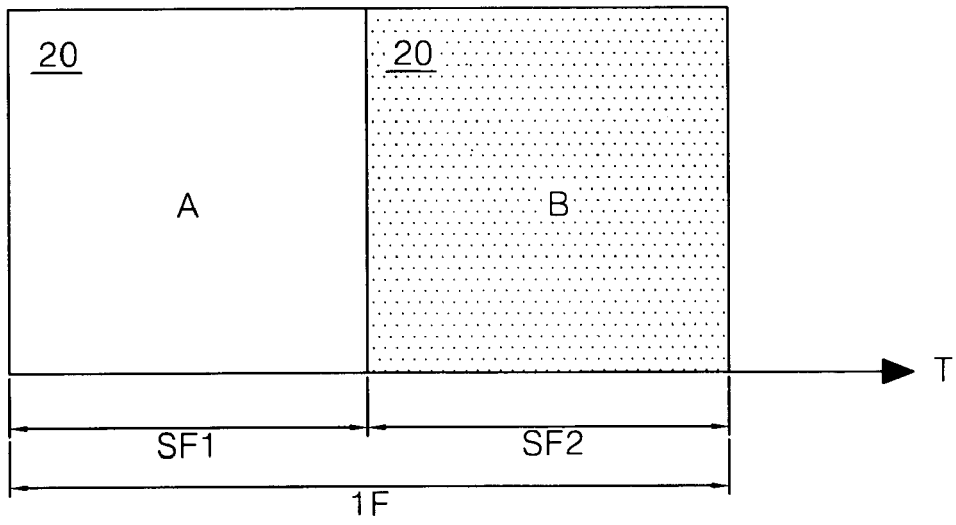
FIG. 3 is a frame configuration diagram illustrating a liquid crystal display driving method according to an embodiment of the present invention.

FIG. 3 illustrates a driving method of a liquid crystal display for wide viewing angle according to the present invention using a time division method, thereby materializing Halftone Grayscale method.

Referring to FIG. 3, one frame (1F:16.7 ms, when refresh rate is 60 Hz) that is allocated to display one grayscale in an arbitrary liquid crystal cell (20), is divided by time into at least two sub-frames (SF1, SF2). Such a time division becomes possible by driving the frame at high speed using a liquid crystal with Optically Compensated Birefringence (OCB) mode that has a response speed less than 10 ms.

Figure 4:
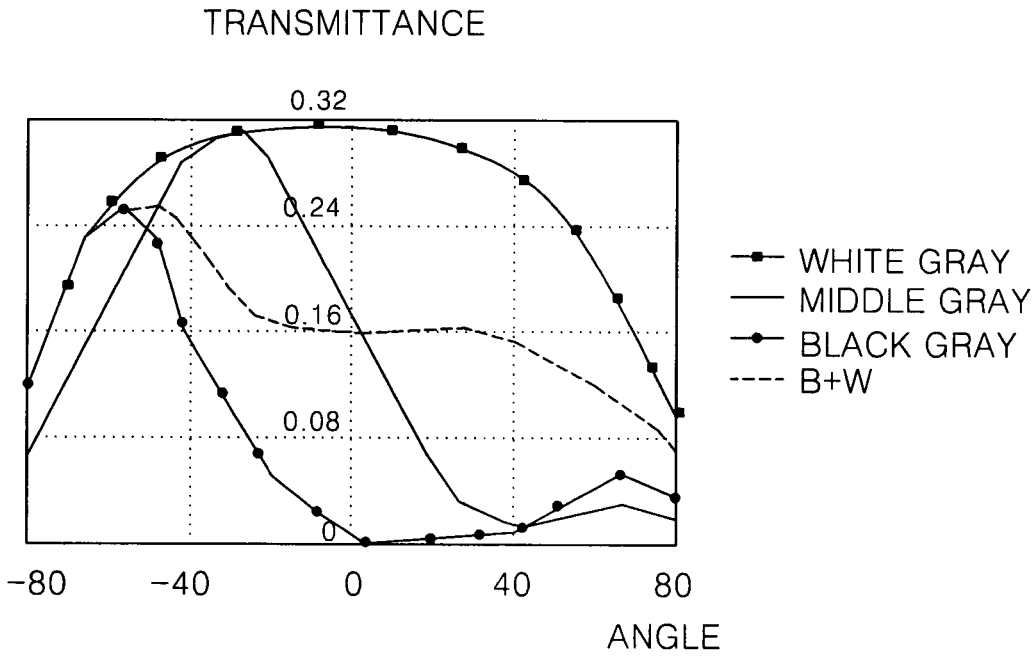
FIG. 4 is a diagram illustrating brightness and viewing angle relationship in a liquid crystal display driving method according to an embodiment of the present invention.

The first and the second sub-frame (SF1, SF2) continuously materialize the grayscale (A, B) with a good viewing angle characteristics. The grayscale corresponding to the liquid crystal cell (2) is materialized by the sum of the grayscale (A, B) materialized in the two sub-frames (SF1, SF2). Accordingly, in the TN mode, the middle grayscale with poor viewing angle characteristics shown in FIG. 4, is obtained by the sum of the grayscales with relatively good viewing angle characteristics, that is, white grayscale and black grayscale after continuous materialization of the grayscales. As a result, the viewing angle of the liquid crystal cell (20) where the middle grayscale is materialized by the sum (W+B) of the white grayscale and the black grayscale can be improved.

For instance, if it is desired to display a brightness of 60% that is included in the middle grayscale at the liquid crystal cell (20), a brightness of 100% corresponding to the white grayscale is displayed in the first sub-frame (SF1), and a brightness of 20% close to the black grayscale is displayed in the second sub-frame (SF2), thereby simultaneously obtaining the desired middle grayscale and improving the viewing angle.

When obtaining the grayscale, by time-dividing one frame (1F) into two sub-frames (SF1, SF2), either of the following two methods can be used.

Firstly, the middle grayscale with poor viewing angle characteristics is obtained by combining two sub-frames (SF1, SF2) that materialize the whole range of grayscale with good viewing angle characteristics. In this case, when it is desired to display brightness "C" in the liquid crystal cell (20) for a frame (1F), it is advantageous to set up the grayscale of the two sub-frames (SF1, SF2) in a way of displaying the brightness of a range of below 80% of the "C" in one sub-frame and displaying the brightness of a range of over 120% of the "C" in the other sub-frame for keeping good viewing angle characteristics.

Secondly, the grayscale of the two sub-frames (SF1, SF2) is set up to produce only black or white grayscale in one sub-frame and to produce the whole grayscale in the other sub-frame. More particularly, if the brightness to be displayed in one liquid crystal cell (20) is over 50%, one sub-frame between the two sub-frames (SF1, SF2) is set up to display white grayscale, that is, a brightness of 100%. Whereas, if the brightness to be displayed in one liquid crystal cell (20) is below 50%, one sub-frame of the two sub-frames (SF1, SF2) is set up to display black grayscale, that is the brightness of 0%. In this case, at least one sub-frame between the two sub-frames (SF1, SF2) has good viewing angle characteristics, thereby the viewing angle can be improved in the whole.

Furthermore, when using liquid crystal with faster response speed, it is possible to produce a grayscale with poor viewing angle characteristics by the combination of a plurality of grayscales, that is, 3, 4 or more, that are not less than 2 and have good viewing angle characteristics.

Figure 5:
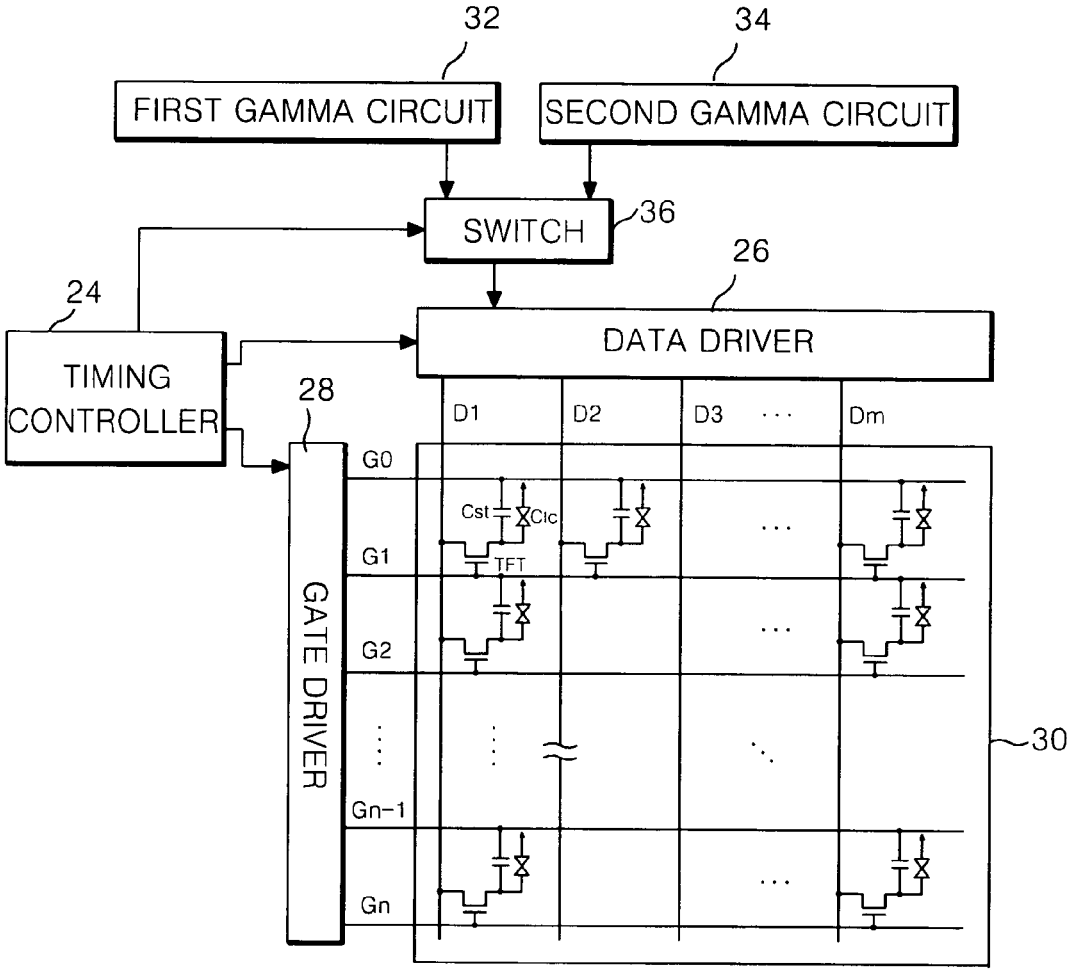
FIG. 5 is a block diagram illustrating a liquid crystal display driving apparatus according to an embodiment of the present invention.

Accordingly, a liquid crystal display driving method of the present invention that produces a grayscale with good viewing angle characteristics by means of the combination of at least 2 grayscales, can be attained by the liquid crystal display driving apparatus which includes two gamma circuits having different gamma voltage setting values from each other as shown in FIG. 5 and that are selectively driven.

Referring to FIG. 5, the liquid crystal display driving apparatus for wide viewing angle according to an embodiment of the present invention includes a gate driver (28) for driving gate lines (G1 to Gn) of the liquid crystal display (30), a data driver (26) for driving data lines (D1 to Dm) of the liquid crystal display (30), a first gamma circuit (32) and a second gamma circuit (34) for supplying gamma voltage to the data driver (26), a switch (36) for selectively connecting the first and the second gamma circuit (32, 34) to the data driver (26), and a timing controller (24) for controlling the gate driver (28), the data driver (26) and the switch (36).

The timing controller (24) responds to clock signals, horizontal and vertical signals and other signals from a system driver (not shown) and controls the driving timing of the gate driver (28) and the data driver (26). More particularly, the timing controller (24) responds to the clock signals and the horizontal and vertical synchronous signals to generate gate clock signals, gate control signals, gate start pulses and etc, and then supplies them to the gate driver (28). Also, the timing controller (24) responds to input clock signals and the horizontal and vertical synchronous signals to generate data clock signals, polarity reverse signals and other signals, and then supplies those signals to the data driver (26). Furthermore, it synchronizes with the data clock signals to supply red, greed and blue video data to the data driver (26).

In this case, the timing controller (24) includes a frame memory (not shown) and outputs the same one frame portion of the video data twice, from the first frame and then to the second sub-frame (SF1, SF2). For outputting twice the same video data for one frame time (1F), the timing controller (24) adopts them to have twice frequency the control signals, such as the clock signals, the horizontal and vertical synchronous signals and other signals, that are input together with the video data from the system driver (not shown). And it outputs the control signals required for the driving control of the data driver (26) and the gate driver (28). In addition, the timing controller (24) generates switching control signals to control a switching action of the switch (36) that selectively outputs gamma voltages of the first and the second gamma circuit (32, 34). For example, the timing controller (24) controls the switch (36) to output the gamma voltages of the first gamma circuit (32) during the first sub-frame (SF1) and the gamma voltages of the second gamma circuit (34) during the second sub-frame (SF2).

The gate driver (28) responds to the gate clock signals, the gate control signals, the gate start pulse and other signals. It sequentially supplies scan signals to the gate lines (G1 to Gn) to drive TFT's connected to the corresponding gate line. Especially, the gate driver (28) scans the gate lines (G1 to Gn) twice for the two sub-frames (SF1, SF2) to be driven for one frame interval (F1).

The first and the second gamma circuit (32, 34) generate direct current gamma voltages that are predetermined to have different voltage levels from one another in accordance with the grayscale. Especially, the first and the second gamma circuits (32, 34) are set up to have grayscale values in relation to the same brightness, that is, gamma voltage, as shown in FIG. 6.

Figure 6:
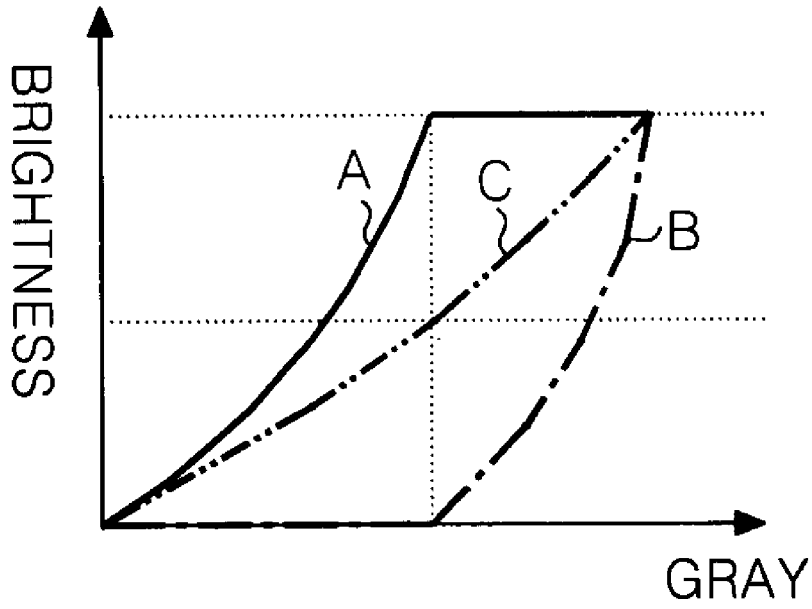
FIG. 6 is a diagram illustrating the brightness and grayscale (gamma voltage) relationship in a first and a second gamma circuit shown in FIG. 5.

Particularly, if the brightness to be displayed is assumed to be "C" and the brightness to be displayed in the two sub-frames (SF1, SF2) is assumed to be "A" and "B", the gamma voltages in the first and the second gamma circuits (32, 34) are set up to always realize the condition of "C=(A+B)/2" in reference with FIG. 6.

The first gamma circuit (32) generates a gamma voltage to be used in the first sub-frame (SF1). For this, a plurality of gamma voltages corresponding to each grayscale in the first gamma circuit (32) are set up to display the brightness changed along the curve "A" in the relation diagram of the brightness and the grayscale shown in FIG. 6.

The second gamma circuit (34) generates a gamma voltage to be used in the second sub-frame (SF2). For this, a plurality of gamma voltages corresponding to each grayscale in the second gamma circuits (34) are set up to display the brightness changed along the curve "B" shown in FIG. 6.

In this manner, the gamma voltages generated at the first and the second gamma circuits are combined making it possible to display the real brightness changed along the curve "C" shown in FIG. 6.

The switch (36) responding to the switching control signals from the timing controller (24) selectively connects the first and the second gamma circuits (32, 34) to the data driver (26).

The data driver (26) converts the video data signals to analog signals supplied from the first or the second gamma circuit (32, 34) and supplies the signals to the data lines (D1 to Dm) one horizontal line per one horizontal period when scan signals are supplied to the gate line (GL).

In other words, upon the driving of the first sub-frame (SF1), the data driver (26) converts the video data signals to analog signals supplied from the first gamma circuit (32) via the switch (36) and supplies the signals to the data lines (D1 to Dm). Subsequently, upon the driving of the first sub-frame (SF1), the data driver (26) converts the video data signals to analog signals supplied from the second gamma circuit (34) via the switch (36) and supplies the signals to the data lines (D1 to Dm)

The liquid crystal display (30) includes liquid crystal cells (20) arranged in matrix shape, thin film transistors (TFT) formed at each intersection of n pieces of gate lines (G1 to Gn) and m pieces of data lines (D1 to Dm). The TFT's respond to the scan signals from the gate lines (G1 to Gn) to supply the video signals from the data lines (D1 to Dn) to the liquid cells (20).

The liquid crystal cell (20) can equivalently be displayed as a liquid crystal capacity capacitor (Clc) that includes common electrodes facing each other with liquid crystal therebetween and a pixel electrode connected to the TFT. A storage capacitor (Cst) is also formed in the liquid crystal cell (20) for sustaining the charged data voltage at the liquid crystal capacity capacitor (Clc) until the next data voltage is charged. The storage capacitor (Cst) is formed between the previous gate line and the pixel electrode.

Such a liquid crystal display (30) is driven by time-dividing one frame (1F) into the first and the second sub-frames (SF1, SF2), and produces the desired grayscale by means of combining the grayscales produced in the two sub-frames (SF1, SF2). In this case, because the middle grayscale with poor viewing angle characteristics can be produced by the combination of the grayscales in the range where the viewing angle characteristics are good, the viewing angle can be improved.

In addition to the driving method of time-dividing one frame (1F) into two sub-frames (SF1, SF2), there are driving methods of time-dividing one frame into not less than three sub-frames.

For instance, the driving method of time-dividing one frame (1F) into three sub-frames, similarly includes three gamma circuits where the gamma voltages in relation to the same brightness are set up differently from one another. This method can produce the grayscale by repeatedly outputting the same video data from the timing controller three times per one frame (1F) and selectively supplying the gamma voltage from the three gamma circuits to the data driver.

Similarly to this, one frame can be time-divided into four or more sub-frames to be driven. Such a time division driving is possible based on a high speed driving of liquid crystal. Studies for high speed driving of liquid crystal are actively in progress, and it is reported that the response speed of liquid crystal is down to 3 ms in case of OCB liquid crystal. Therefore, the above-mentioned time division driving can be obtained.

As described above, the liquid crystal display driving apparatus and the method thereof for wide viewing angle according to the present invention time-divides the grayscale with poor viewing angle characteristics into at least two grayscales in the ranges where the viewing angle characteristics are good, to drive and then combine the grayscales for realization, thereby improving the viewing angle.

It will be apparent to those skilled in the art that various modifications and variations can be made in the LCD driving apparatus and method of driving a liquid crystal display of the present invention without departing from the spirit and scope of the invention. Thus, it is intended that the present invention cover the modifications and variations of this invention provided they come within the scope of the appended claims and their equivalents.

What is claimed is:

1. A method of driving a liquid crystal display for wide viewing angle, including:

selecting a first sub-grayscale based on a corresponding first grayscale viewing angle characteristic;

selecting a second sub-grayscale based on a corresponding second grayscale viewing angle characteristic; and time-dividing one-frame into at least two sub-frames such that an arbitrary main grayscale is expressed by a combination of the first sub-grayscale and the second sub-grayscale, wherein at least one of the first sub-grayscale and the second sub-grayscale is a black grayscale or a white grayscale.

2. The method according to claim 1, wherein the first sub-grayscale and the second sub-grayscale are set up to have a value, which is calculated by dividing the sum of the first sub-grayscale and the second sub-grayscale by the number of the sub-frames.

3. The method according to claim 1, wherein when the liquid crystal display is driven by dividing the one-frame into two sub-frames, the first sub-grayscale expressed in one sub-frame is set up to have a value of approximately less than 80% in regards to the main grayscale, and the second sub-greyscale expressed in the other sub-frame is set up to have a value of approximately greater than 120% in regards to the main grayscale.

4. The method according to claim 1, wherein if a brightness corresponding to the main grayscale is less than 50%, one of the sub-frames is set up to display black grayscale, and if the brightness corresponding to the main grayscale is larger than 50%, one of the sub-frames is set up to display white grayscale.

5. The method according to claim 1, wherein the first and second sub-grayscales use video data corresponding to the main grayscale, and convert the video data to analog signals using gamma voltages set up differently from one another for every sub-frame in relation to the same brightness so as to supply to the liquid crystal display.

6. A method of driving a liquid crystal display for wide viewing angle, comprising:

repeatedly outputting video data input from outside every sub-frame during one frame that is composed of at least two sub-frames;

supplying gamma voltages that are set up differently from one another every sub-frame in relation to the same brightness; and converting the video data into analog signals using the gamma voltages, and supplying the signals to the liquid crystal display to display, wherein a desired grayscale is expressed by means of the combination of grayscales respectively selected for their viewing angle characteristics expressed at the sub-frames so that the desired grayscale has a uniformly wide viewing angle property, and wherein at least one of the sub-frames expresses black grayscale or white grayscale.

7. The method according to claim 6, wherein the sub-grayscales are set up to have a value, which is calculated by dividing the sum of the sub-grayscales by the number of the sub-frames.

8. The method according to claim 6, wherein when one frame includes two sub-frames, a grayscale expressed in one sub-frame is set up to have the value of approximately less than 80% in regards to the desired grayscale, and a grayscale expressed in the other sub-frame is set up to have the value of approximately greater than 120% in regards to a desired grayscale.

9. The method according to claim 6, wherein if the brightness corresponding to the main grayscale is less than 50%, one of the sub-frames is set up to display black grayscale, and if the brightness corresponding to the main grayscale is larger than 50%, one of the sub-frames is set up to display white grayscale.

10. A driving apparatus for a liquid crystal display, comprising:

a liquid crystal display including a plurality of gate lines, a plurality of data lines and a plurality of liquid crystal cells;

a timing controller repeatedly outputting a plurality of control signals and video data, input from outside;

at least two gamma circuits supplying gamma voltages set differently from one another in relation to the same brightness, wherein the gamma voltages are respectively selected based on a corresponding viewing angle characteristic, and wherein at least one of the gamma circuits supplies gamma voltage corresponding to black grayscale or white grayscale;

a gate driver responding to the control of the timing controller and driving the gate lines;

a data driver responding to the control of the timing controller and driving the data lines; and a switch responding to the control of the timing controller and selectively connecting the gamma circuits with the data driver every sub-frame.

11. The driving apparatus according to claim 10, wherein gamma voltages corresponding to each of grayscale values in the gamma circuits are set up to have a value, which is calculated by dividing the sum of grayscales corresponding to the sub-frame by the number of the sub-frames, to always be a grayscale desired to be displayed.

12. The driving apparatus according to claim 10, wherein the number of the gamma circuits required is two when the one frame has two sub-frames, and any one gamma circuit of the two gamma circuits generates gamma voltages corresponding to grayscales having the value of approximately below 80% in regard to grayscales desired to be displayed, and the other gamma circuit generates gamma voltage corresponding to grayscales having the value of approximately above 120% in regard to grayscales desired to be displayed.

13. The driving apparatus according to claim 12, wherein if the brightness corresponding to the grayscales desired to be displayed is less than 50%, one of the gamma circuits supplies the gamma voltage corresponding to black grayscale to the data driver, and if the brightness corresponding to the grayscales desired to be displayed is larger than 50%, one of the gamma circuits supplies the gamma voltage corresponding to white grayscale to the data driver.

* * * * *